US007121857B1

(12) United States Patent
Lewis

(10) Patent No.: US 7,121,857 B1
(45) Date of Patent: Oct. 17, 2006

(54) TOLERANCE-ABSORBING INTERCONNECT SYSTEM USING A SPRING-LOADED CONNECTOR

(75) Inventor: Jeffrey M. Lewis, Maynard, MA (US)

(73) Assignee: EMC Corporation, Hopkinton, MA (US)

( * ) Notice: Subject to any disclaimer, the term of this patent is extended or adjusted under 35 U.S.C. 154(b) by 0 days.

(21) Appl. No.: 11/089,817

(22) Filed: Mar. 25, 2005

(51) Int. Cl.
*H01R 13/64* (2006.01)

(52) U.S. Cl. ..... 439/247; 439/248

(58) Field of Classification Search ..... 439/247, 439/248, 246, 564, 66, 562
See application file for complete search history.

(56) References Cited

U.S. PATENT DOCUMENTS 5,137,462 A * 8/1992 Casey et al. ..... 439/74
5,397,244 A * 3/1995 Generoli et al. ..... 439/248
5,997,328 A * 12/1999 Kodama et al. ..... 439/247
6,346,007 B1 * 2/2002 Yokoi ..... 439/564
6,422,886 B1 * 7/2002 Macbeth et al. ..... 439/247
6,592,387 B1 * 7/2003 Komenda et al. ..... 439/247
6,679,712 B1 * 1/2004 Chang ..... 439/248
6,884,096 B1 * 4/2005 Centola et al. ..... 439/157

* cited by examiner

*Primary Examiner*—Alexander Gilman
(74) *Attorney, Agent, or Firm*—Guerin & Rodriguez, LLP; Michael A. Rodriguez

(57) ABSTRACT

Described is a connector assembly and interconnect system for absorbing physical tolerances. The connector assembly includes a shoulder screw, a spring, and an electrical connector. A barrel portion of the screw passes through hole in a flange of the connector. Secured to a structural member is a threaded portion of the screw. Coiled about the barrel portion of the screw, between the connector body and the structural member, is the spring. The interconnect system includes a second connector for mating with the electrical connector. One connector can be mounted in a chassis and the other to a subassembly. When the subassembly slides into the chassis, the connectors mate and compress the spring. A securing mechanism then couples the subassembly to the chassis, keeping the spring compressed and urging connectors against each other.

14 Claims, 8 Drawing Sheets

TOLERANCE-ABSORBING INTERCONNECT SYSTEM USING A SPRING-LOADED CONNECTOR

FIELD OF THE INVENTION

The invention relates generally to interconnect systems. More particularly, the invention relates to spring-loaded electrical connectors for absorbing physical design tolerances.

BACKGROUND

In the design and manufacture of electronic systems, physical tolerances define the acceptable maximum deviation from the specified norm for a dimension of a component part or assembly. In some electronic systems, it is difficult to satisfy these tolerances and still produce good interconnectivity among the various components within the system. For example, consider an electronic system having a chassis and an electronic subassembly that enters into and couples to the chassis. This subassembly has an electrical connector configured to mate with an electrical connector of the chassis. For the electronic system to operate properly, the mating electrical connectors need to make minimal contact engagement and remain fully mated throughout the operation of the electronic system. Accordingly, tolerances affecting these connectors are determined such that the mating connectors are "bottomed out," that is, fully engaged—one connector has penetrated the other connector as far as possible. This fully engaged condition presents the best opportunity for electrical contact between the electrical connectors.

To keep such connectors fully engaged, usually the subassembly is latched or locked within the chassis. Tolerances apply also to the placement of the latch mechanism on the subassembly and of any corresponding latch receptacle on the chassis. Considered in the determination of these latching mechanism tolerances are those of the connectors. For instance, there can be specified tolerances from the latch mechanism on the subassembly to the connector on the subassembly, from the connector on the subassembly to the connector on the chassis, and from the connector on the chassis to the internal latch receptacle on the chassis. Thus, proper latching between the subassembly and chassis involves complex, simultaneous satisfaction of numerous physical tolerances. If, for example, these tolerances indicate that the placement of the latch mechanism on the subassembly has a tolerance window of plus or minus 80 thousandths of an inch, then the chassis needs a latch receiving region measuring 160 thousandths of an inch wide gap to accommodate the various potential placements of the latch mechanism. Thus, a worst-case compliant system design can have almost 160 thousandths of an inch movement of the subassembly within the chassis. Movement of this magnitude can allow the latch mechanism to move during vibration and shock of the electronic system. Such movement can disengage the mating connectors and cause the electronic system to fail.

Further, mating electrical connectors have a preferred measure of "wipe", that is, a minimum overlap between the mating connectors so that the act of joining the connectors operates to remove oxidants from the conductive elements, referred to as contacts, and thus improve electrical conductivity. The various tolerances can reduce this overlap to an unsatisfactory length. Thus, there is a need for a system capable of accommodating the various physical tolerances in an electronic system while providing robust mechanical connectivity and electrical conductivity between mating connectors.

SUMMARY

In one aspect, the invention features a tolerance absorbing interconnect system for use in an electronics enclosure. A first connector assembly is mounted to a first enclosure portion. A second connector assembly is movably mounted to a structural member of a second enclosure portion. The second connector assembly is configured for mating with the first connector assembly. The second connector assembly has a connector body, a shoulder screw, and a spring. The connector body has a flange with a hole therein. The shoulder screw has a barrel portion that passes through the hole in the flange and a threaded portion that enters a hole in the structural member. Coiled around the barrel portion of the shoulder screw between the flange and the structural member is a spring. The interconnect system also includes a securing mechanism for coupling the first enclosure portion to the second enclosure portion when the first connector assembly mates with and pushes against the second connector assembly, causing the spring to compress. Whereupon, when the securing mechanism couples the first enclosure portion to the second enclosure portion, the spring remains compressed and urges the second connector assembly against the first connector assembly to maintain an interconnection therebetween.

In another aspect, the invention features a connector assembly comprising an electrical connector having a connector body and a standoff having a first end and an opposite end. The standoff is movably coupled at the first end to the connector body of the electrical connector and fixedly coupled at the other end to a structural member. The electrical connector is able to move toward the structural member while remaining coupled to the standoff. A spring member is disposed between the connector body of the electrical connector and the structural member. One end of the spring member opposes the connector body and the other end of the spring member opposes the structural member. The spring member compresses when the electrical connector is urged towards the structural member.

In still another aspect, the invention features a tolerance-absorbing interconnect system, comprising a chassis having an open end and a first securing mechanism. The interconnect system also has a structural member, a first connector having a connector body with a flange having a hole therein, a fastener having an elongated barrel portion passing through the hole in the flange, and means for coupling the fastener to the structural member. A spring member is coiled around the barrel portion of the fastener between the flange and the structural member. In addition, the interconnect system includes an assembly having a second connector and a second securing mechanism for coupling to the first securing mechanism when the assembly slides a predetermined distance into the chassis through the open end. The distance is such that, in order for the securing mechanisms to couple, the first and second connectors mate and push against each other to compress the spring member. Whereupon when the securing mechanisms couple, the spring member remains compressed and urges one of the connectors against the other connector.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

The invention features an interconnect system for absorbing various physical tolerances associated with the placement of mechanical securing mechanisms and mating electrical connectors in a chassis and subassembly of an electronics system. One of the mating electrical connectors is mounted to a structural member of the chassis, and the other extends from a rear side of the subassembly; one of these electrical connectors is spring-loaded, that is, one or more springs are disposed between the body of the electrical connector and the chassis structural member (or subassembly rear side) to which the electrical connector is attached. When the subassembly is inserted into the chassis, the electrical connectors approach, meet, and join each other. After the mating connectors "bottom out," i.e., fully engage, additional force on the subassembly operates to push back on the spring-loaded connector, compressing its spring(s), until the securing mechanisms of the chassis and subassembly engage. Once engaged the subassembly remains secure within the chassis, and the compressed spring(s) of the spring-loaded connector exert a force urging the chassis and subassembly apart. Releasing the securing mechanisms causes the subassembly to pop partially out of the chassis.

Figure 1:
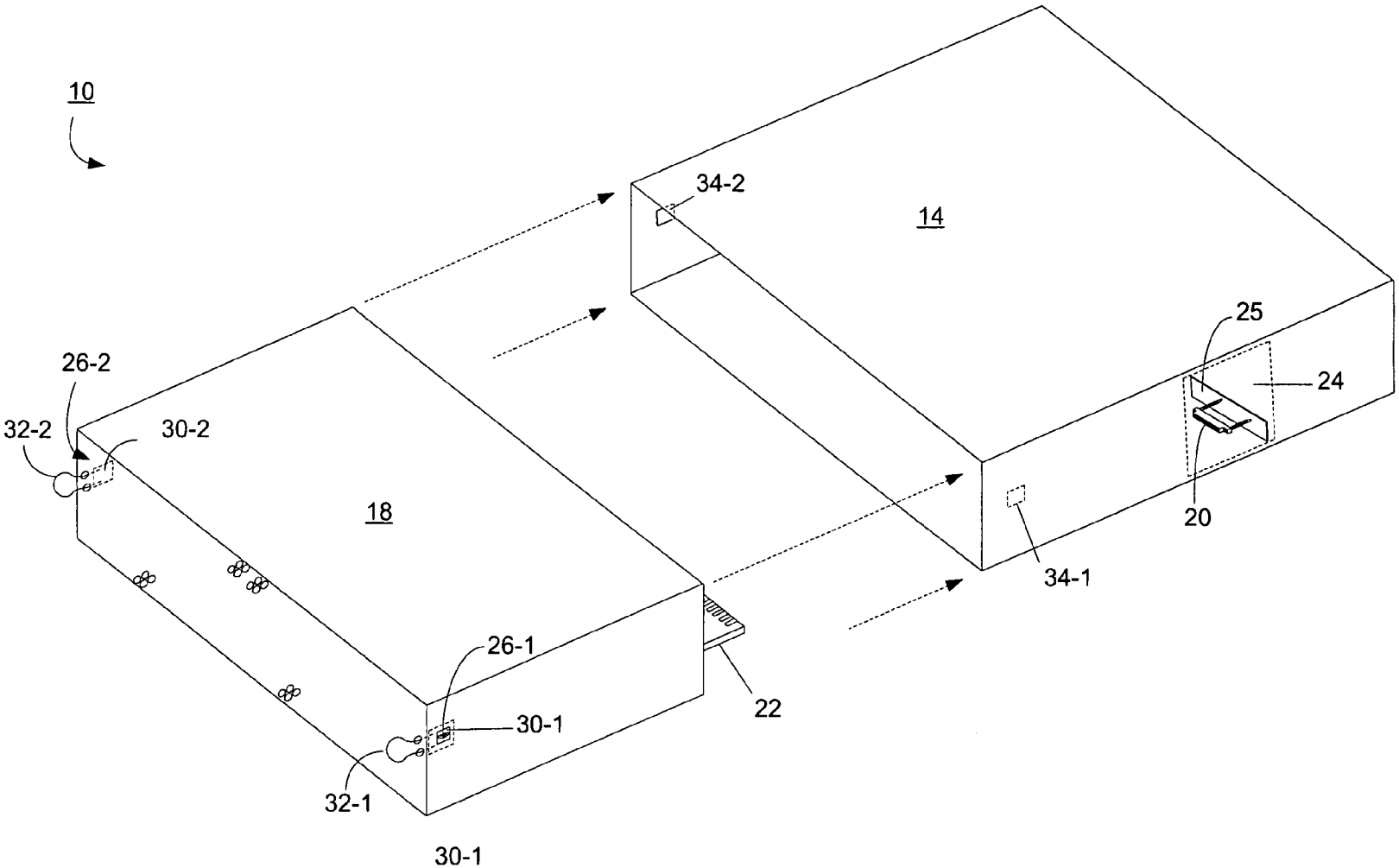
FIG. 1 is a diagram of an embodiment of an electronics module constructed in accordance with the invention, the electronics module being comprised of a subassembly and a chassis.

FIG. 1 shows an exploded view of an oversimplified embodiment of an electronics system 10 having a chassis 14 and a sliding subassembly 18 (e.g., a drawer, module). Examples of electronics systems in which the invention may be embodied include data storage systems, application servers, personal computers. The subassembly 18 fits closely inside of the chassis 14. The chassis 14 and subassembly 18 have mating electrical connectors 20, 22, respectively, also referred to together as a rack and panel connector. Mounted in the chassis 14 to a structural member 25, such as a wall or a bulkhead, is the electrical connector 20; the other electrical connector 22 is attached to the backside of the sliding subassembly 18. For illustration purposes, a cutout region represented by a dashed box 24 exposes the electrical connector 20 to show an example placement of the electrical connector within the chassis 14. The chassis 14 and subassembly 18 can each have a plurality of such mating electrical connectors aligned so that pairs of mating connectors join simultaneously when the subassembly 18 enters the chassis 14.

In general, one of the mating connectors 20, 22, is spring-loaded as described in more detail below, and the other is directly attached (i.e., to the subassembly or to the chassis). In a preferred embodiment, shown in FIG. 1, the electrical connector 20 within the chassis 14 is a spring-loaded, female panel or panel-mount connector and the electrical connector 22 at the rear side of the subassembly is an edge connector with gold contact fingers. Typically, before the present invention, panel connectors were immovably mounted to a wall or panel, e.g., with screws and nuts. The present invention provides a movably mounted spring-loaded panel connector, as described further below.

In an alternative embodiment, the subassembly 18 has the spring-loaded panel connector and the chassis has the edge connector. Other embodiments can have a spring-loaded edge connector (whether attached to the subassembly or to the chassis), while the panel connector is immovable attached (to the other enclosure portion). In general, either mating connector can be of any type, e.g., male, female, right-angle, straight, edge, panel, etc., provided such the connectors can mate with each other in the course of inserting the subassembly into the chassis.

The subassembly 18 also includes a latch mechanism 26-1, 26-2 attached to each sidewall. Each latch mechanism 26-1, 26-2 projects through an opening 30-1, 30-2 in the respective sidewall. Coupled to each latch mechanism 26-1, 26-2 is a handle 32-1, 32-2, respectively, to enable a technician to unlock that latch mechanism and to pull the subassembly 18 from the chassis 14. The chassis 14 has a corresponding latch receiver region 34-1, 34-2 on each chassis sidewall for receiving a corresponding one of the latch mechanisms 26-1, 26-2 when the subassembly 18 is inserted into the chassis 14 as described herein.

Figure 2:
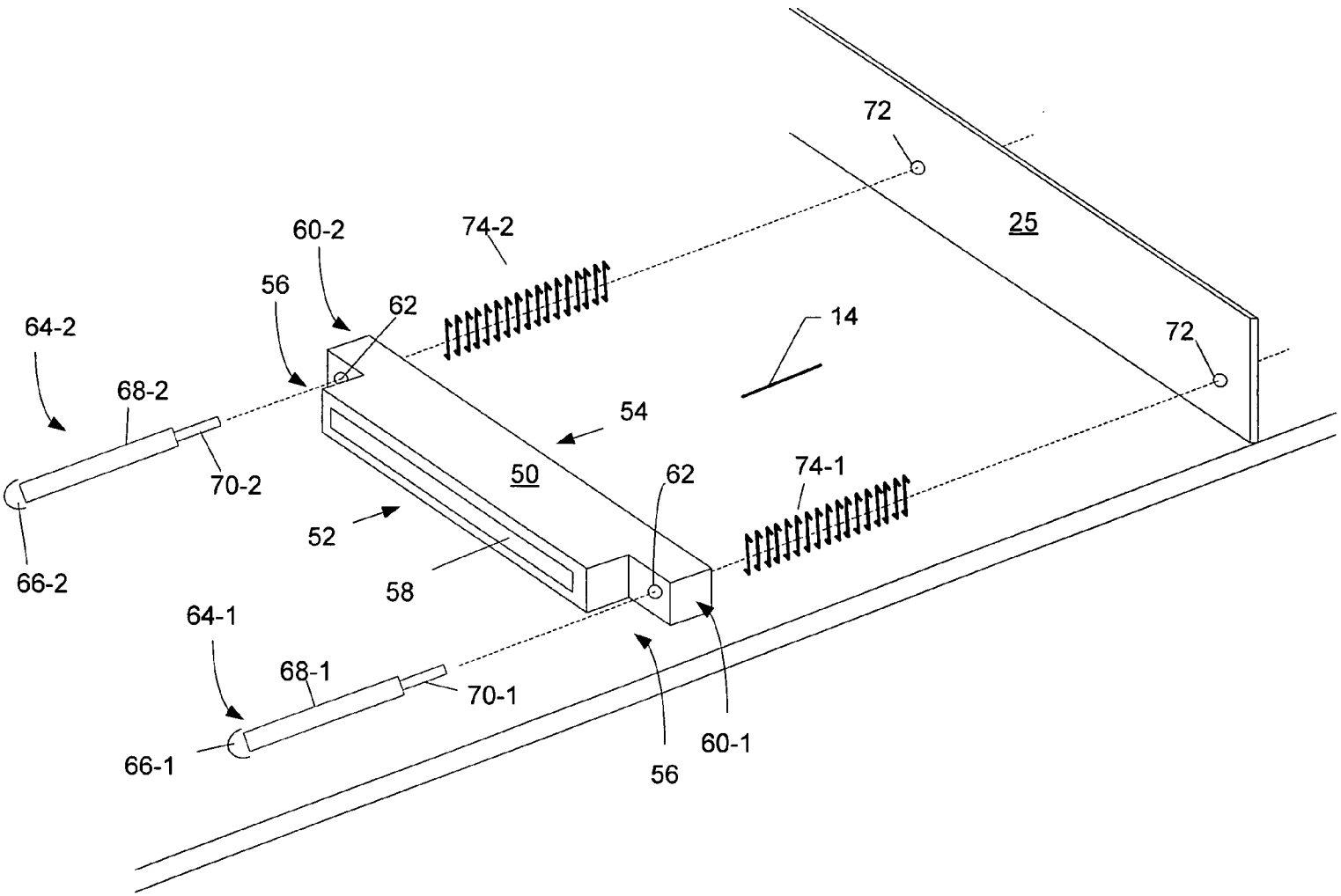
FIG. 2 is an exploded view diagram of an embodiment of a spring-loaded panel connector of the present invention.

FIG. 2 shows an exploded view of an embodiment of the spring-loaded panel connector 20 of FIG. 1. In this embodiment, the spring-loaded panel connector 22 has a female connector body 50 with a front side 52, rear side 54, and sides 56. The front side 52 includes an opening 58 for receiving a mating connector. Electrical contacts, i.e., the conductive elements of the connector, are disposed within the opening 58. Conductive wires or cables (not shown) extend from the rear side 54 of the connector body 50. Extending from each side 56 of the connector body 50 is a flange 60-1, 60-2 (generally, 60) with a hole 62.

The spring-loaded panel connector 20 also has a pair of shoulder screws 64-1, 64-2 (generally, 64). Each shoulder screw 64, also referred to as a standoff, has a head 66, a barrel portion 68, and a threaded portion 70. Each shoulder screw 64 enters one of the flange holes 62 from the front side 52 of the connector 20. Each hole 62 has a diameter for closely, but not snugly, receiving the barrel portion 68 of the shoulder screw 64: with the screw 64 passing through the hole 62, the connector body 50 can slide along a length the barrel portion 68. The size of the head 66 of the shoulder screw 64 is greater than the diameter of the hole 62 to restrain the connector body 50. The threaded portion 70 of each shoulder screw 64 enters and projects through a hole 72 in the structural member 25 mounted in the chassis 14. The holes 72 can be threaded for tightly receiving the threaded portions 70, or nuts (not shown) can be used on the opposite side of the structural member 25 to attach to the threaded portions of the screws. The diameter of the barrel portion 68 is greater than the diameter of the hole 72. Accordingly, the length of the barrel portion determines the approximate maximum distance of the connector body 50 from the structural member 25.

Each shoulder screw 64 passes through the center of a spring 74-1, 74-2 (generally, spring 74). The coils of the each spring 74 wrap around a section of the barrel portion 68 between the rear side 54 of the flange 60 and the structural member 25. One end of each spring 74 makes contact with the rear side of a flange and the other end of the spring makes contact with the front surface of the structural member 25.

Figure 4:
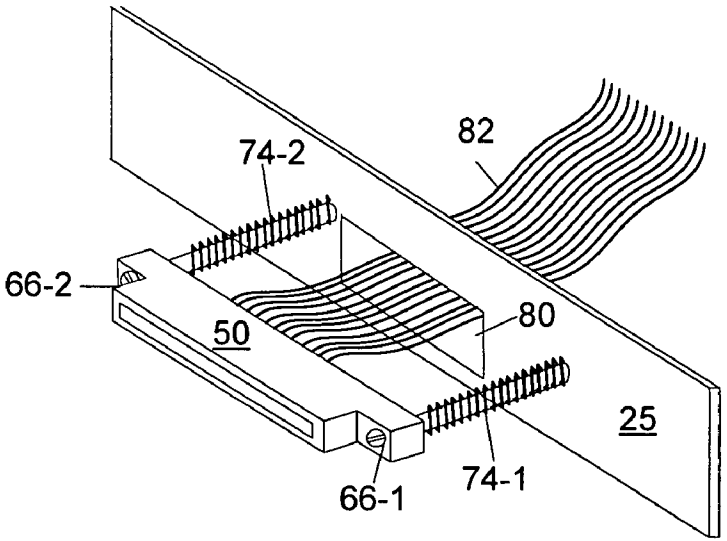
FIG. 4 is a diagram of the spring-loaded panel connector with wires extending from a rear side thereof and passing through an opening in the structural member.
Figure 3:
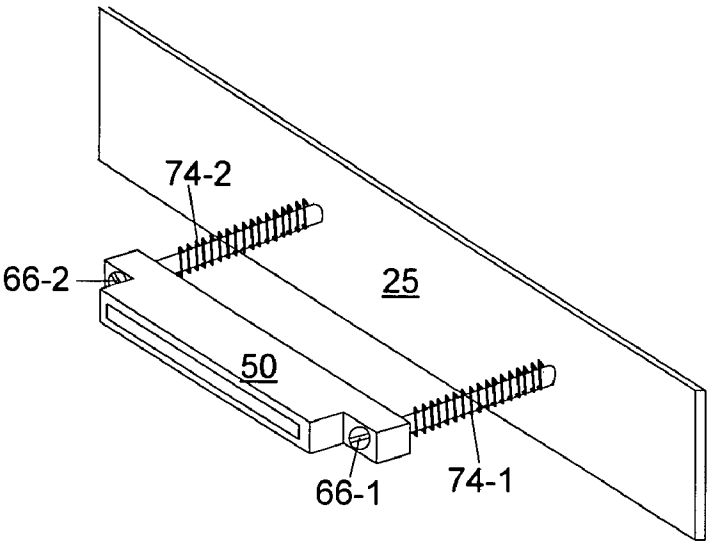
FIG. 3 is a diagram of the spring-loaded panel connector fixedly attached to a structural member, e.g., of the chassis.

FIG. 3 shows the spring-loaded connector 20 mounted to the structural member 25. As shown, the shoulder screws are fixedly coupled to the structural member 25 and movably coupled to the connector body 50. The uncompressed length of the springs is approximately equal to or slightly longer than the length of the barrel portion, measured from the rear surface of the flange to the structural member. Accordingly, when no compressing force is being applied to the connector body 50, the springs are at equilibrium (i.e., uncompressed) or lightly compressed, and the heads 66 of the shoulder screws 64 are flush on the front surface of the flanges 60. Typically, wires or cables extend from the rear side of the connector body 50. As shown in FIG. 4, the structural member 25 can have an opening 80 formed therein for the passage of wires 82. If the structural member 25 does not have such an opening, the wires can pass over the top of the structural member 25 or around the side.

For one embodiment of the tolerance-absorbing interconnect system, FIG. 5–FIG. 9 illustrate various stages of joining the edge connector 22 of the subassembly 18 with the spring-loaded panel connector 20 in the chassis 14. For purposes of simplifying the illustration, representation of the subassembly 18 is reduced to showing the edge connector 22 and the latch mechanisms 26'-1, 26'-2 (generally, 26'). In addition, here the latch mechanisms 26' are shown directly coupled to the edge connector 22. In most embodiments, however, the latch mechanisms 26' are indirectly coupled to the edge connector 22 in that the latch mechanisms 26' and edge connector 22 are coupled to the subassembly 18.

Figure 5:
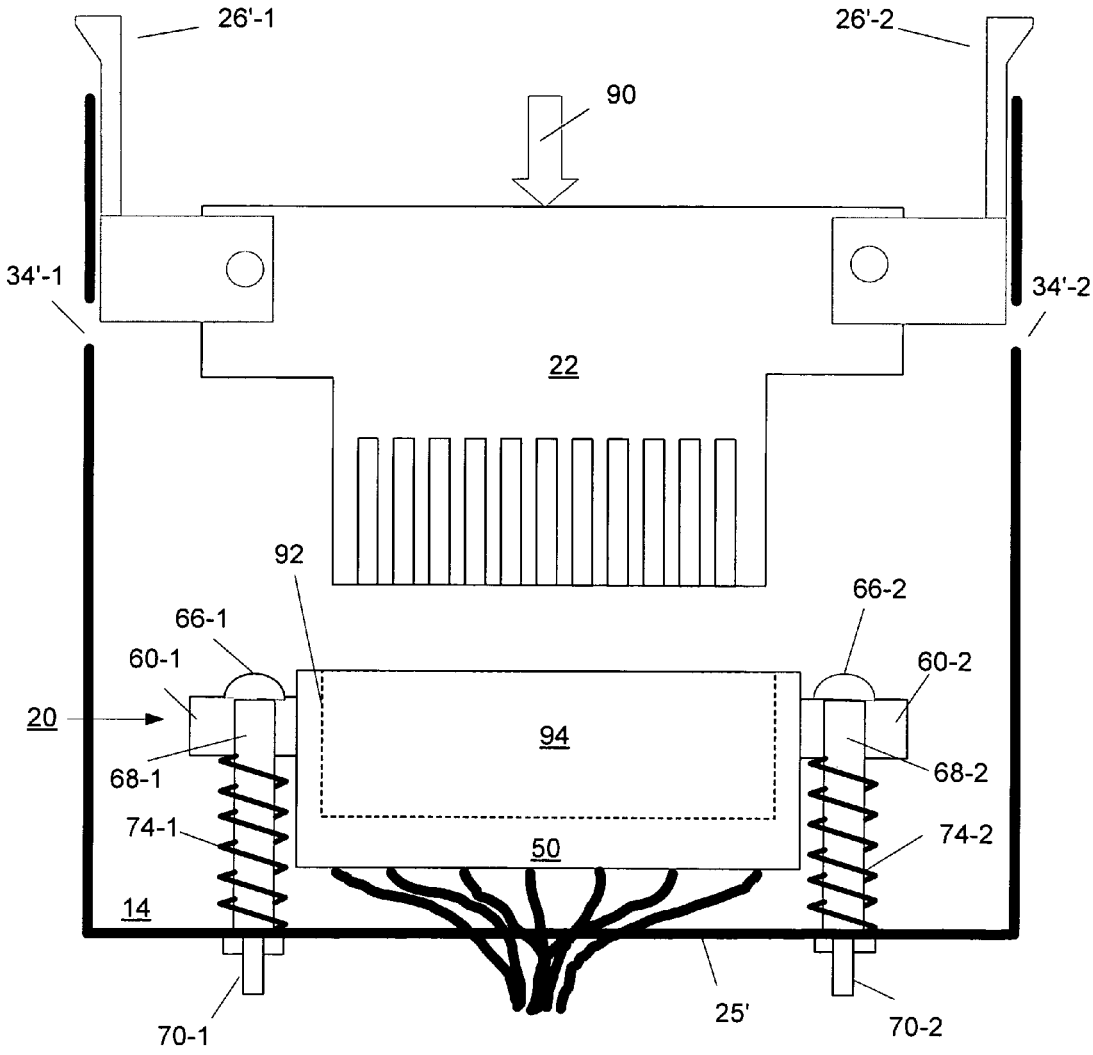
FIG. 5 is a diagram of an embodiment of a subassembly including an edge connector and latching mechanism, and wherein the edge connector approaches a spring-loaded panel connector within a chassis.
Figure 6:
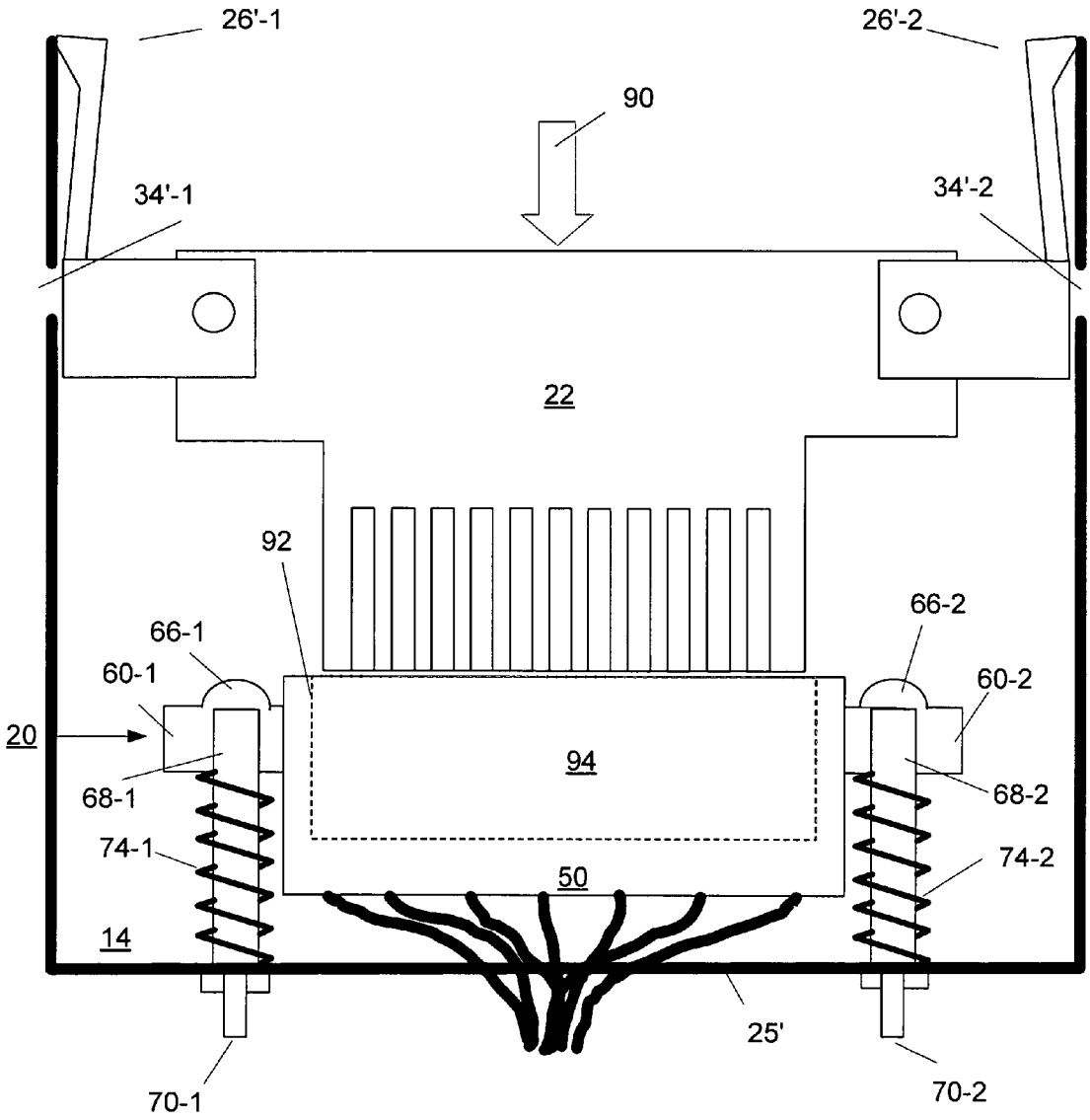
FIG. 6 is a diagram in which the edge connector meets the spring-loaded panel connector.

FIG. 5 shows the edge connector 22 approaching the spring-load panel connector 20 in the direction indicated by the arrow 90. The dashed region 92 represents a cavity 94 within the connector body 50 in which are located the plurality of conductive elements. FIG. 6 shows the edge connector 22 coming into initial contact with the spring-loaded connector 20, with the sidewalls of the chassis 14 pushing the latch mechanisms 26' inwards. At this point of initial contact, the spring-loaded connector 20 begins to resist the force joining the subassembly 18 to the chassis 14.

An advantage provided by the spring-loaded panel connector 20, movably anchored rather than rigidly mounted to the structural member 25' by the shoulder screws, is that the panel connector 20 has some inherent "float" or relative movement. This relative movement allows for the connectors 20, 22 to mate easily without putting undo stress on either connector. For instance, the ability of the panel connector to move horizontally or vertically (in addition to back and forth along the direction of the shoulder screws) enables the panel connector 20 to adapt to any minor misalignment between the connectors 20, 22.

Preferably, the force needed to compress the springs is greater than the force needed to slide the edge connector 22 into the cavity 94 of the spring-loaded panel connector 20 so that the springs 74 can remain uncompressed as the edge connector 22 slides into the spring-loaded panel connector 20. In one embodiment, the force for mating the connectors 20, 22 is approximately 3 pounds of load, while the insertion force to start compressing the springs 74 is in a range of approximately 4 to 4½ pounds of load. Other spring rates can be used to practice the invention, although springs requiring too great a compression force can make manual insertion of the subassembly 18 into the chassis 14 difficult for a technician.

Figure 7:
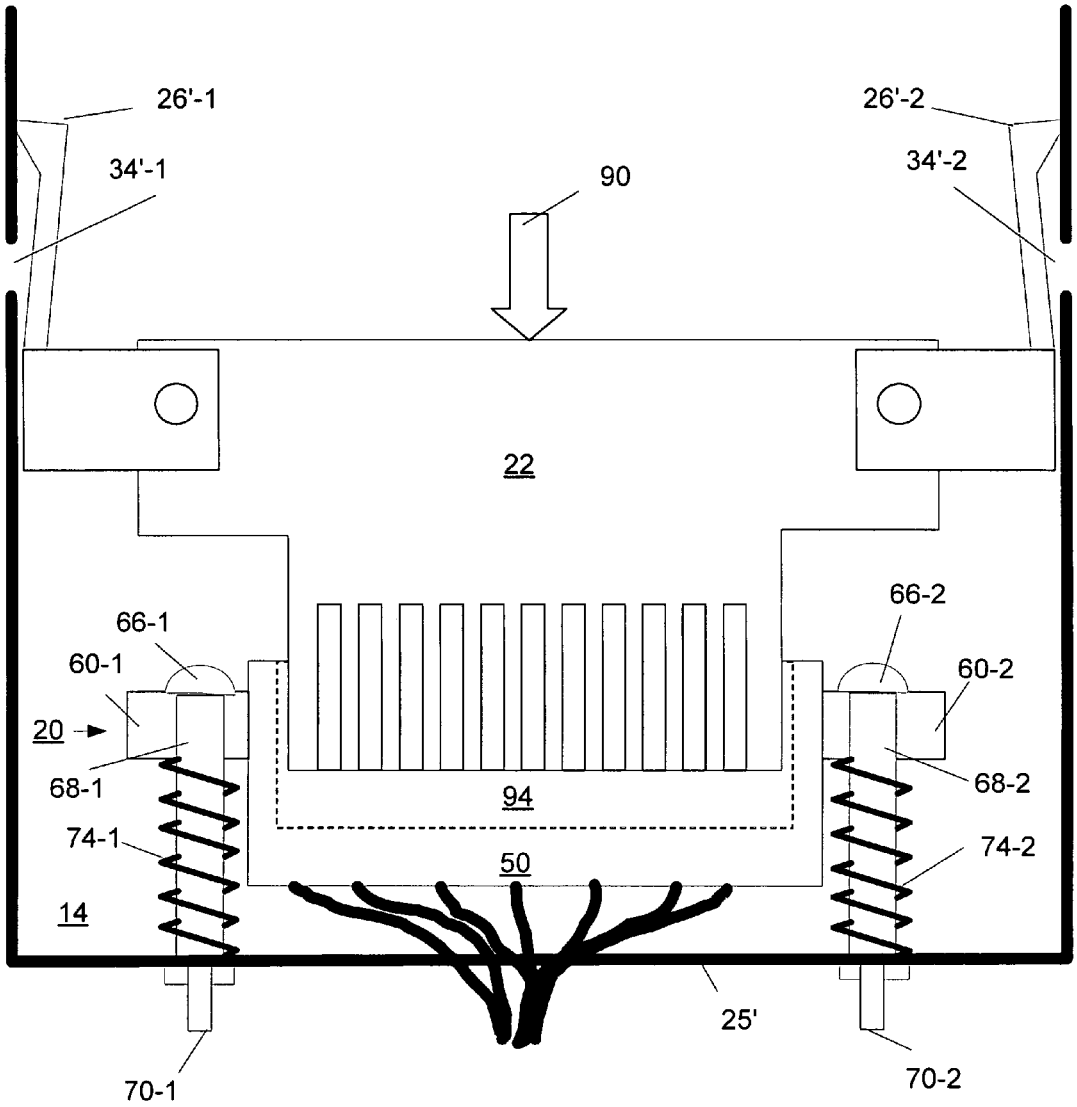
FIG. 7 is a diagram in which the edge connector enters the spring-loaded panel connector.
Figure 8:
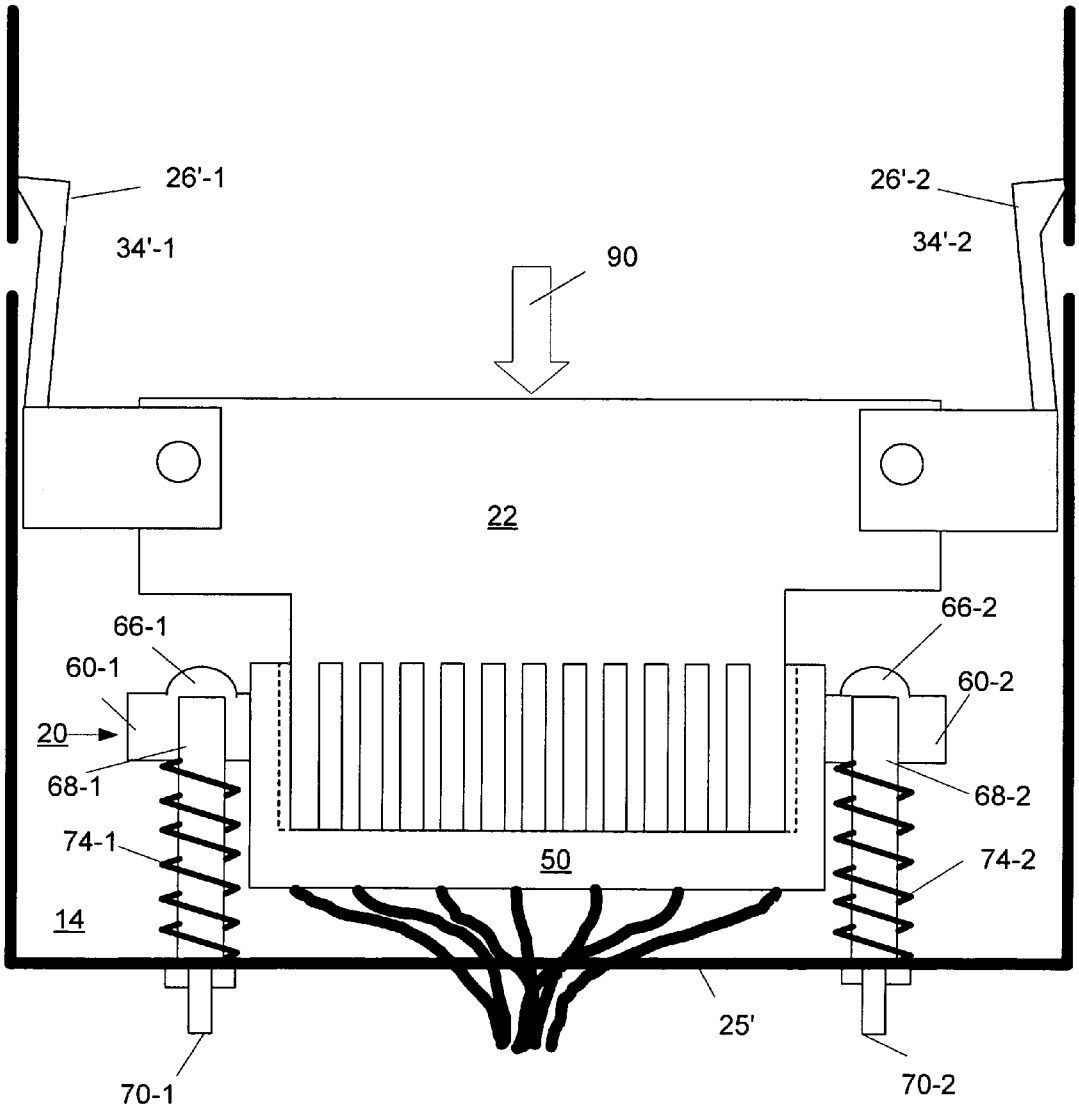
FIG. 8 is a diagram in which the edge connector bottoms out within the spring-loaded panel connector.

In FIG. 7, the edge connector 22 enters the cavity 94 of the spring-loaded panel connector 20, and FIG. 8 shows the edge connector 22 "bottoming out," that is, the edge connector 22 has penetrated fully the cavity 94. When the edge connector 22 has bottomed out, the latch mechanisms 26' have not yet reached the latch receiving regions 34' in the sidewalls of the chassis 14. The subassembly 18 needs to penetrate further into the chassis 14 to cause the latch mechanisms 26' to latch. This requires the application of additional force to the edge connector 22, in excess of the spring rate of the springs, in order to compress the springs 74. The pressing force of the edge connector 22 causes the spring-loaded panel connector 20 to move towards the anchoring structural member 25' along the barrel portions 68 of the shoulder screws.

Figure 9:
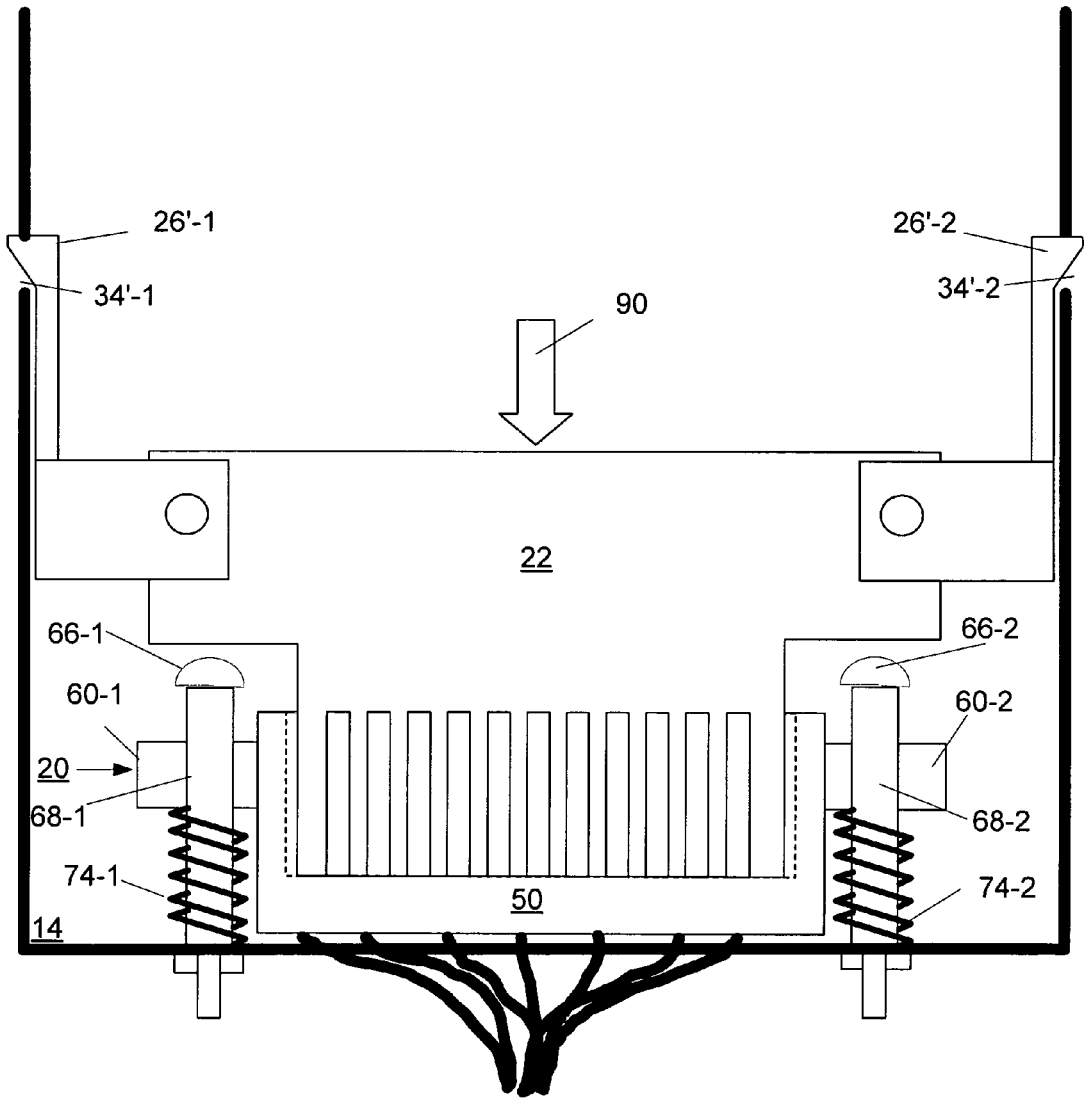
FIG. 9 is a diagram in which the edge connector urges the spring-loaded panel connector rearward in the chassis until the latching mechanism latches the subassembly to the chassis.

As shown in FIG. 9, when penetration of the subassembly 18 into the chassis 14 reaches a predetermined distance, the latch mechanisms 26' spring into the latch receiver regions 34', locking the mating connectors 20, 22 together. An audible sound may occur when the latch mechanisms 26' snap into the latch receiver regions 34'. It is to be understood that this latch technique is but one of many different securing mechanisms that can be used to couple the subassembly 18 to the chassis 14 in the practice of the invention.

When the subassembly 18 and chassis 14 are latched, the springs 74 are in a compressed state and, thus, urge the spring-loaded panel connector 20 against the edge connector 22. The shape of the latch mechanisms 26' and manner of engagement with the latch-receiver regions 34' prevent the force of the springs from pushing the subassembly 18 back out of the chassis 14. By urging each latch mechanism 26' towards one end of the respective latch-receiver region 34', the physical tolerances designed into the size of the latch receiving regions 34' are absorbed. Further, the electrical contact between the mating connectors 20, 22 is improved and capable of withstanding vibration and shock to the electronic system 10 because the springs 74 urge the spring-loaded connector 20 against the edge connector 22 while the latch receiving regions 34 restrict the subassembly 18 and, thus, the edge connector 22 from moving.

When a technician disengages the latch mechanisms 26', the force exerted by the springs 74 operates to pop the subassembly 18 partially from the chassis 14. This partial ejection of the subassembly 18 gives the technician a tactile indication that the subassembly 18 has become unlatched.

While the invention has been shown and described with reference to specific preferred embodiments, it should be understood by those skilled in the art that various changes in form and detail may be made therein without departing from the spirit and scope of the invention as defined by the following claims. For example, in an embodiment described above, shoulder screws are movably coupled to the connector body and fixedly coupled to the structural member. An alternative embodiment can have the shoulder screws fixedly coupled to the connector body and movably coupled to the structural member. As another example, in an embodiment described above, the spring-loaded connector is embodied in the chassis and the mating connector in the sliding assembly. An alternative embodiment can have the spring-loaded connector in the sliding assembly and the mating connector fixed inside the chassis. As still another example, the principles of the invention may be applied to different types of connectors other than the electrical connectors described herein.

What is claimed is:

1. A tolerance-absorbing interconnect system for use in an electronics enclosure, comprising:

a first connector assembly mounted to a first enclosure portion;

a second connector assembly movably mounted to a structural member of a second enclosure portion, the second connector assembly being configured for mating with the first connector assembly, the second connector assembly having a connector body, a shoulder screw, and a spring, the connector body having a flange with a hole therein, the shoulder screw having a barrel portion that passes through the hole in the flange and a threaded portion that fixedly attaches to the structural member, the spring being coiled around the barrel portion of the shoulder screw between the flange and the structural member, the connector body sliding along the barrel portion of the shoulder screw when the second connector assembly is urged towards the structural member; and a securing mechanism including a latch mechanism on a sidewall of the first enclosure portion and a latch receiver region formed in a sidewall of the second enclosure portion, the latch mechanism on the sidewall of the first enclosure portion latching to the latch receiver region in the sidewall of the second enclosure portion when the first connector assembly mates with and pushes against the second connector assembly causing the spring to compress, whereupon when the latch mechanism on the sidewall of the first enclosure portion latches to the latch receiver region in the sidewall of the second enclosure portion, the spring remains compressed and urges the second connector assembly against the first connector assembly to maintain an interconnection therebetween.

2. The interconnect system of claim 1, wherein the connector body has a second flange with an hole therein, and the second connector assembly includes a second spring and a second shoulder screw with a barrel portion that passes through the hole of the second flange and a threaded portion that enters a second hole in the structural member, the second spring being coiled around the barrel portion of the second shoulder screw between the second flange and the structural member.

3. The interconnect system of claim 1, wherein the threaded portion is fixedly coupled to the structural member.

4. The interconnect system of claim 1, wherein the connector body of the second connector assembly is movably coupled to the shoulder screw for movement along the barrel portion.

5. The interconnect system of claim 1, wherein the second enclosure portion includes a chassis and the first enclosure portion includes a subassembly that inserts into the chassis.

6. An electronics enclosure assembly, comprising:

a subassembly having an edge connector extending from one end thereof;

a chassis with a structural member;

a panel connector having a connector body;

a standoff having a first end and an opposite end, the standoff being movably coupled at the first end to the connector body of the panel connector and fixedly coupled at the other end to the structural member, the panel connector sliding along the standoff when the panel connector is urged towards the structural member; and a spring member disposed between the connector body of the panel connector and the structural member, one end of the spring member opposing the connector body and the other end of the spring member opposing the structural member, the spring member compressing when the edge connector enters the panel connector;

a latch mechanism on a wall of one of the chassis and subassembly;

a latch receiver region in a wall of the other of the chassis and subassembly, the latch mechanism latching to the latch receiver region to secure the subassembly within the chassis when the edge connector mates with the panel connector.

7. The electronics enclosure assembly of claim 6, wherein the connector body has a flange projecting from a side of the connector body and the flange has an opening therein through which the standoff passes.

8. The electronics enclosure assembly of claim 6, wherein the standoff includes a shoulder screw with a head, a barrel portion movably coupled to the connector body, and a threaded portion that is fixedly coupled to the structural member, and the connector body has a flange with a hole therein, the barrel portion of the shoulder screw passing through the hole in the flange with the head of the shoulder screw keeping the connector body movably coupled to the barrel portion.

9. The electronics enclosure assembly of claim 8, wherein the spring member is coiled around the barrel portion of the shoulder screw.

10. The electronics enclosure assembly of claim 6, further comprising a second standoff having a first end and an opposite end, the first end of the second standoff being movably coupled to the connector body and the opposite end of the second standoff being fixedly coupled to the structural member.

11. The electronics enclosure assembly of claim 10, further comprising a second spring member disposed between the connector body and the structural member, one end of the second spring member opposing the connector body and the other end of the spring member opposing the structural member, each spring member being coiled around one of the standoffs.

12. A tolerance-absorbing interconnect system for use in an electronics enclosure, the interconnect system comprising:

a chassis having an open end a sidewall, and a latch receiver region formed in the sidewall;

a structural member;

a first connector having a connector body with a flange having a hole therein;

a fastener having an elongated barrel portion passing through the hole in the flange to movably couple the connector body of the first connector to the fastener so that the connector body can slide on the barrel portion of the fastener when the first connector is urged towards the structural member;

means for fixedly coupling the fastener to the structural member;

a spring member coiled around the barrel portion of the fastener between the flange and the structural member; and an assembly having a second connector, a sidewall, and a latch mechanism on the sidewall, the latch mechanism latching to the latch receiver region in the sidewall of the chassis when the assembly slides a predetermined distance into the chassis through the open end, the distance being such that, in order for the latch mechanism to latch to the latch receiver region, the first and second connectors mate and push against each other to compress the spring member, whereupon when the latch mechanism latches to the latch receiver region, the spring member remains compressed and urges one of the connectors against the other connector.

13. The interconnect system of claim 12, wherein the structural member is within the chassis.

14. The interconnect system of claim 12, wherein the connector body has a second flange with an hole therein, and further comprising a second spring, a second fastener with a barrel portion that passes through the hole of the second flange, and second means for coupling the second fastener to the structural member, the second spring being coiled around the barrel portion of the second fastener between the second flange and the structural member.

* * * * *